US006125254A

United States Patent [19]

Chang et al.

[11] Patent Number: 6,125,254

[45] Date of Patent: Sep. 26, 2000

[54] INK LEAKAGE PREVENTION SYSTEM FOR LIQUID ELECTROPHOTOGRAPHIC PRINTER HAVING A DEVELOPMENT TRAY

[75] Inventors: Kee-son Chang, Suwon; Ji-won Seo, Kunpo; Jin-geun Kwak, Suwon, all of Rep. of Korea

[73] Assignee: Samsung Electronics Co., Ltd., Kyungki-Do, Rep. of Korea

[21] Appl. No.: 09/440,471

[22] Filed: Nov. 15, 1999

[30] Foreign Application Priority Data

Nov. 14, 1998 [KR] Rep. of Korea ..... 98-48885
Jun. 3, 1999 [KR] Rep. of Korea ..... 99-20480

[51] Int. Cl.[7] ..... G03G 15/10

[52] U.S. Cl. ..... 399/237; 222/DIG. 1; 347/84; 141/348; 141/364; 399/233

[58] Field of Search ..... 399/237, 249, 399/233, 119, 120; 222/DIG. 1; 347/84, 85; 141/346–350, 363, 364

[56] References Cited

U.S. PATENT DOCUMENTS 3,651,782 3/1972 MacDonald ..... 118/411
4,375,864 3/1983 Savage ..... 141/349 X
5,031,676 7/1991 Ulm ..... 141/346
5,467,806 11/1995 Stricklin ..... 141/346
5,971,532 10/1999 Toda ..... 347/86
6,032,010 2/2000 Kim et al. ..... 399/238
6,048,055 4/2000 Hakkaku ..... 347/86

*Primary Examiner*—Richard Moses
*Attorney, Agent, or Firm*—Sughrue, Mion, Zinn, Macpeak & Seas, PLLC

[57] ABSTRACT

An ink leakage prevention system, for a liquid electrophotographic printer having a development tray, which includes a chassis, installed at a main body of the printer, a development tray, installed at the lower portion of a development unit and is detachable from the main body of the printer, wherein the developing tray accommodates developer left over after being used by the development unit for developing and which has a discharge portion for discharging the accommodated developer, a drain tray installed at the chassis to drain the developer discharged from the development tray into a circulation tank, and a discharge portion opening/shutting means for closing the discharge portion when the development tray is separated from the drain tray and for opening the discharge portion when the development tray is coupled to the drain tray. Thus, when the development tray is replaced or repaired, the parts in the main body of the printer are prevented from being damaged by any developer remaining in the development tray. Further, the present invention provides a simple structure wherein the packing holder which houses the packing member is directly installed in the discharge portion.

33 Claims, 11 Drawing Sheets

INK LEAKAGE PREVENTION SYSTEM FOR LIQUID ELECTROPHOTOGRAPHIC PRINTER HAVING A DEVELOPMENT TRAY

BACKGROUND OF THE INVENTION

1. Field of the Invention

The present invention relates to a liquid electrophotographic printer, and more particularly, to an ink leakage prevention system of a development tray for a liquid electrophotographic printer which prevents leakage of the ink contained in the development tray installed at a development unit when the development tray is installed in or separated from a main body of the printer for replacement or repair.

2. Description of the Related Art

Generally, a liquid electrophotographic printer, such as a laser printer or a copier, uses developer to first form an electrostatic latent image on a photoreceptor medium so and then produces a desired image on paper, or the like. The liquid electrophotographic printer, as shown in FIG. 1, includes a development roller 12, a cleaning roller 14, a squeegee roller 16, a blade 18, a manifold 20, a development unit 26, having development tank 22, a development tray 24, and a circulation tank 28, disposed under development unit 26.

The circulation tank 28 is provided with condensed ink and a liquid carrier from an ink tank (not shown) or a carrier tank (not shown) through a developer supply inlet 30. The circulation tank 28 mixes the ink and carrier to form developer which comprises a mixture of condensed ink, made of toner of a predetermined color, and a liquid carrier functioning as a solvent. The developer in circulation tank 28 is supplied to the development unit 26 by means of a pump 32 and a valve 34. The manifold 20, installed in the development unit 26, injects developer into a development gap G formed between a photoreceptor medium 36 and the development roller 12. The injected developer adheres to the photoreceptor medium 36 as a result of a difference in surface energy between the photoreceptor medium 36 and the development roller 12. After development is performed by development roller 12, any remaining developer on development roller 12 is cleaned by cleaning roller 14 and stored in the development tank 22. Any developer stored in the development tank 22 or squeezed by the squeegee roller 16 and wiped by the blade 18 is collected in the lower portion of the development tray 24. The collected developer is thereafter returned to the circulation tank 28 via a path 38.

When components in the development unit 26, for example, development roller 12, cleaning roller 14, or squeegee roller 16 are broken, or the injection angle or height of the manifold 20 is incorrect, the development unit 26 must be disassembled from a main body of the printer for repair and replacement.

In a printer having the above structure, disassembling the development unit 26 from the main body of the printer is difficult. Further, any developer remaining around outlet 24*a* of the development tray 24 may fall on components of the main body of the printer, possibly damaging parts of the main body of the printer. If the developer contacts expensive parts, such as an optical system of a laser unit (not shown), damage becomes serious.

Accordingly, several potentially damaging situations may arise in a typical printer structure as describe above wherein the development unit and the circulation tank are vertically arranged in order to reduce the size of the main body of the printer. Many methods have been suggested for solving the above problem, such as placing the development unit and the circulation tank at the front side and rear side of the main body of the printer, respectively, and/or providing an inclined surface at the lower portion of the development tray and installing a quick valve at the lower portion of the inclined surface. The above suggestions are impractical because they complicate the printer structure and are cost prohibitive since they require additional valve opening/shutting devices to open/shut the quick valve.

SUMMARY OF THE INVENTION

In order to solve the above problems, it is an objective of the present invention to provide an ink leakage prevention system for a liquid electrophotographic printer having a development tray of improved structure so that when a development tray is separated from a main body of the printer for replacement or repair of the development unit, the ink in the development tray does not damage components of the printer disposed around the development unit.

Accordingly, to achieve the above objective, there is provided an ink leakage prevention system for a liquid electrophotographic printer having a development tray, comprising a chassis installed at a main body of the printer and a development tray for accumulating developer not used during development in development unit. The development tray is detachably installed in a lower portion of a development unit in the main body of the printer and comprises a discharge portion for discharging the accommodated developer, a drain tray installed at the chassis to drain the developer discharged from the development tray to a circulation tank, and discharge portion opening/shutting means for closing the discharge portion when the development tray is separated from the drain tray and opening the discharge portion when the development tray is coupled to the drain tray.

It is preferred in the present invention that the discharge portion opening/shutting means comprises a packing holder installed on a rib which is formed as an extension of the discharge portion to allow pivoting; a packing member installed in the packing holder to selectively open or shut an outlet formed at the leading end of the discharge portion according to the pivot movement of the packing holder; and a pivoting portion for making the packing holder pivot with respect to the rib.

Also, it is preferred in the present invention that the pivoting portion comprises a spring member placed around a hinge shaft and installed in the rib, to elastically bias the packing holder in a direction so that the packing member closes the outlet. A push member is installed on the chassis to contact the packing holder when the development tray is coupled to the drain tray, thereby countering the elastic force of the spring member to opening the outlet.

Also, it is preferred in the present invention that the ink leakage prevention system further comprises a guide member inserted into the discharge portion. The guide member is formed with a guide portion which directs the flow of developer drops away from the outlet for removal by a contacting blade installed in the drain tray.

Also, it is preferred in the present invention that the discharge portion opening/shutting means comprises an intruder installed in the drain tray, a packing member which is capable of retracting into the discharge portion upon contact with the intruder, and an elastic member, placed between a stopper fixed inside the discharge portion and the packing member, for elastically biasing the packing member toward a leading end of the discharge portion.

Finally, there is provided a method of opening a discharge portion of a development tray placed within a liquid electophotographic printer, having a chassis installed at a main body of said printer, a development tray installed in a development unit of said main body of said printer, a discharge portion of said development tray which discharges developer accumulated in a development unit; and a drain tray installed on said chassis which receives the developer discharged from said development tray, comprising the steps of (a) placing said discharge portion of said development tray to a receiving portion of said drain tray; and (b) pushing said development tray toward said drain tray so that a protrusion formed on a packing holder pushes against a push member located on said chassis, thereby causing said packing holder to pivot and open an outlet on said discharge portion of said development tray.

BRIEF DESCRIPTION OF THE DRAWINGS

The above objective and advantages of the present invention will become more apparent by describing in detail a preferred embodiment thereof with reference to the attached drawings in which:

FIGS. 3 and 4 are side views of the ink leakage prevention system, in which FIG. 3 shows a state before a development tray is assembled to a chassis and FIG. 4 shows a state after the development tray is assembled to the chassis;

FIGS. 7 and 8 are side views of the ink leakage prevention system, in which FIG. 7 shows a state before a development tray is assembled to a chassis and FIG. 8 shows a state after the development tray is assembled to the chassis;

FIGS. 10 and 11 are side views of the ink leakage prevention system shown in FIG. 9, in which FIG. 10 shows a state before a development tray is assembled to a chassis and FIG. 11 shows a state after the development tray is assembled to the chassis.

DETAILED DESCRIPTION OF THE INVENTION

Figure 1:
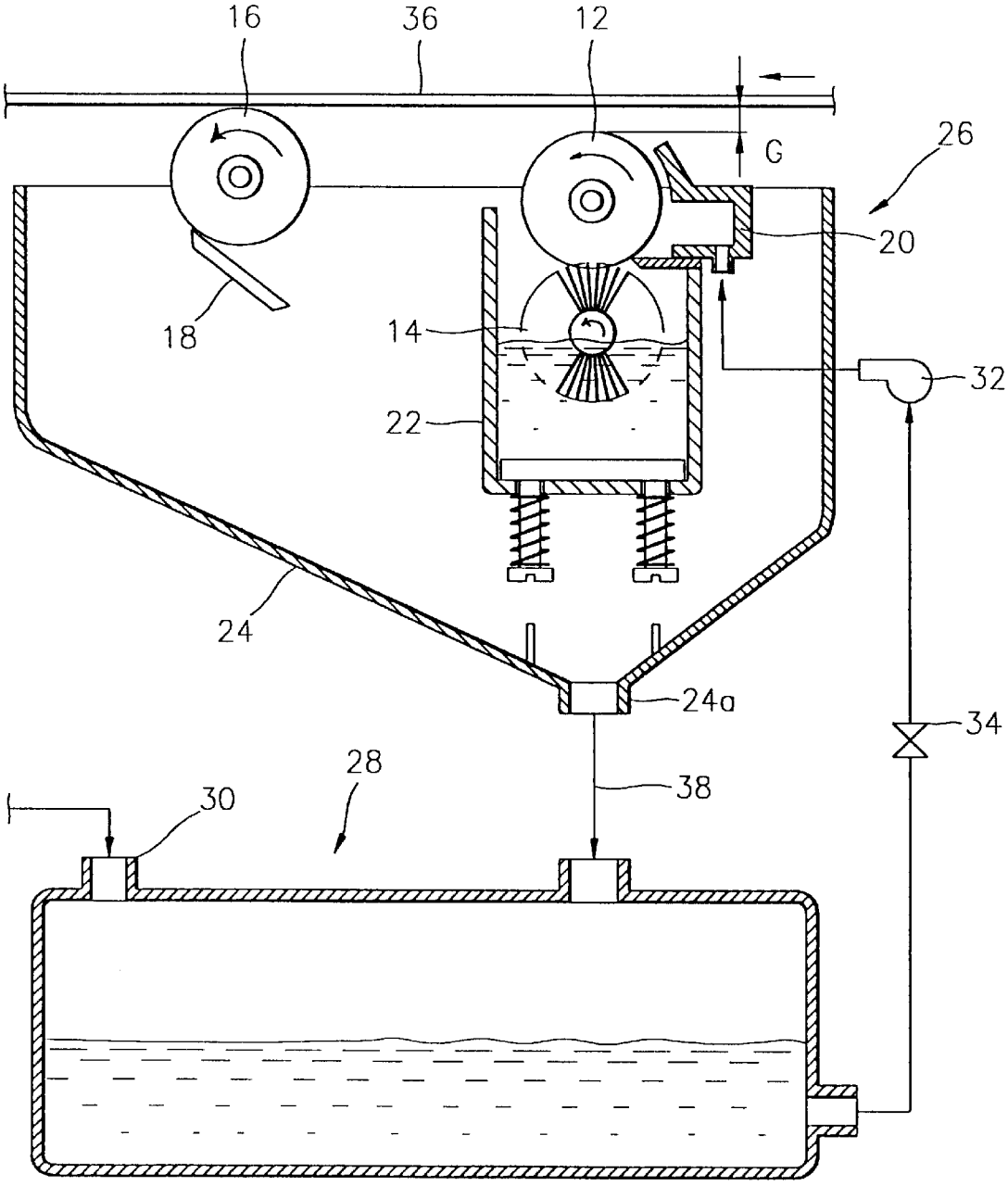
FIG.1 (PRIOR ART)
FIG. 1 is a view showing the development unit and the circulation tank for a conventional liquid electrophotographic printer.
Figure 2:
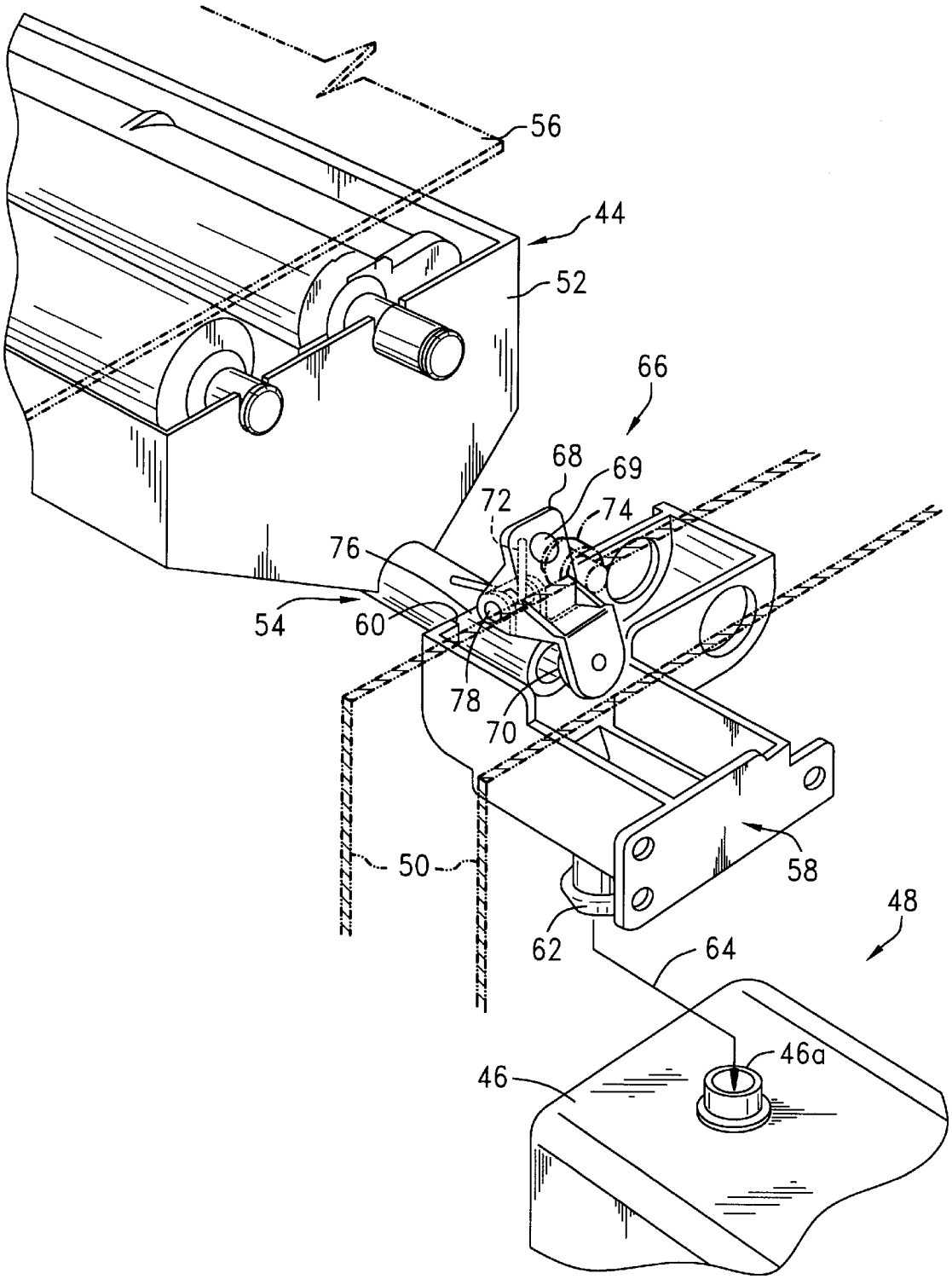
FIG. 2 is a perspective view showing an ink leakage prevention system of a development tray for a liquid electrophotographic printer according to the first preferred embodiment of the present invention.

FIG. 2 shows an ink leakage prevention system for a liquid electrophotographic printer having a development tray according to a first preferred embodiment of the present invention. Referring to FIG. 2, a chassis 50 for sectioning a development unit 44 and a developer supply unit 48 is installed in the main body of a printer. A development tray 52 is installed at the lower portion of the development unit 44 and is detachable from the main body of the printer. The development tray 52 accommodates developer which is supplied from a circulation tank 46 and used in the development unit 44 for developing. The bottom of the development tray 52 is designed with an inclined portion slanted at a predetermined angle with respect to the widthwise direction of a photoreceptor medium 56. A discharge portion 54 is provided at the base of the inclined portion for discharging any developer accumulated in the development tray 52 into the circulation tank 46. For brevity, all the elements described with respect to FIG. 1 are incorporated into the development tray 52 of the present invention, eliminating the need for repetition.

A developer drain tray 58 is installed at the side surface of the chassis 50. The developer drain tray 58 interacts with discharge portion 54 of development tray 52, such that discharge portion 54 contacts or becomes separated from developer drain tray 58 when the development tray 52 is installed in or detached from the main body of the printer. Accordingly, developer drain tray 58 is provided with a receiving portion 60 for accommodating the discharge portion 54. A drain portion 62 is formed at the bottom of the developer drain tray 58 for connecting to circulation tank 46. The drain portion 62 connects to an inlet 46a formed at the circulation tank 46 via a path 64.

A discharge portion opening/shutting means 66 is installed at chassis 50 for receiving the discharge portion 54. When the development tray 52 is separated from the developer drain tray 58, the discharge portion opening/shutting means 66 shuts the discharge portion 54 so that any developer remaining in the development tray 52 cannot be discharged through the discharge portion 54. When the development tray 52 is coupled to the developer drain tray 58, the discharge portion opening/shutting means 66 opens the discharge portion 54 so that development tray 52 is fluidly connected to circulation tank 46. The discharge portion opening/shutting means 66 includes a packing holder 68, a packing member 70, a spring 72 and a push member 74.

The packing holder 68 is hinge-coupled to rib 76, extending from discharge portion 54, and pivots about hinge shaft 78. Packing member 70, installed at one end of the packing holder 68, selectively opens or shuts outlet 55 (see FIG. 3), formed at the leading end of the discharge portion 54, according to the pivot movement of the packing holder 68. Spring 72 is wound around hinge shaft 78 such that the end portions of the spring 72 contact the discharge portion 54 and the packing holder 68. Spring 72 elastically biases packing holder 68 in a direction so that packing member 70 shuts outlet 55 of discharge portion 54. When the development tray 52 is coupled to developer drain tray 58, push member 74, installed on chassis 50, pushes protrusion 69 formed on packing holder 68 so that the packing holder 68 pivots against the elastic force of spring 72 to open outlet 55. Here, the spring 72 and push member 74 act as a pivoting portion to make the packing holder 68 pivot.

Figure 3:
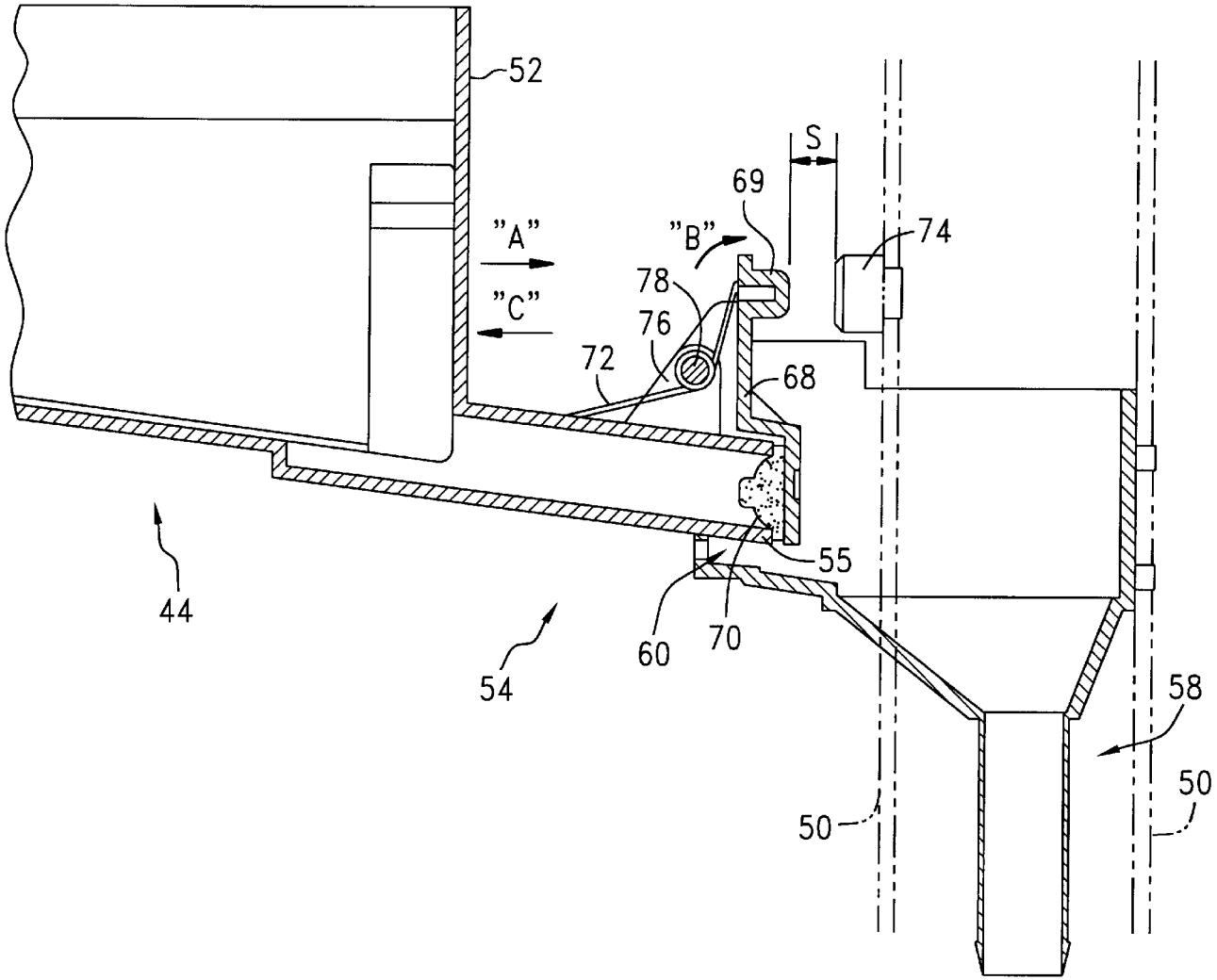

During the operation of the ink leakage prevention system for a liquid electrophotographic printer having a development tray according to the first preferred embodiment of the present invention, as shown in FIG. 3, the packing holder 68 is elastically biased by spring 72. When the development tray 52 is detached from the liquid electrophotographic printer, the elastic force of spring member 72 upon the packing holder 68 causes the packing member 70, installed at the leading end of the packing holder 68, to close outlet 55 of discharge portion 54. Typically, development tray 52 is removed from the main body of the printer to provide a new development tray for the development unit 44 or to repair an existing development tray.

Figure 4:
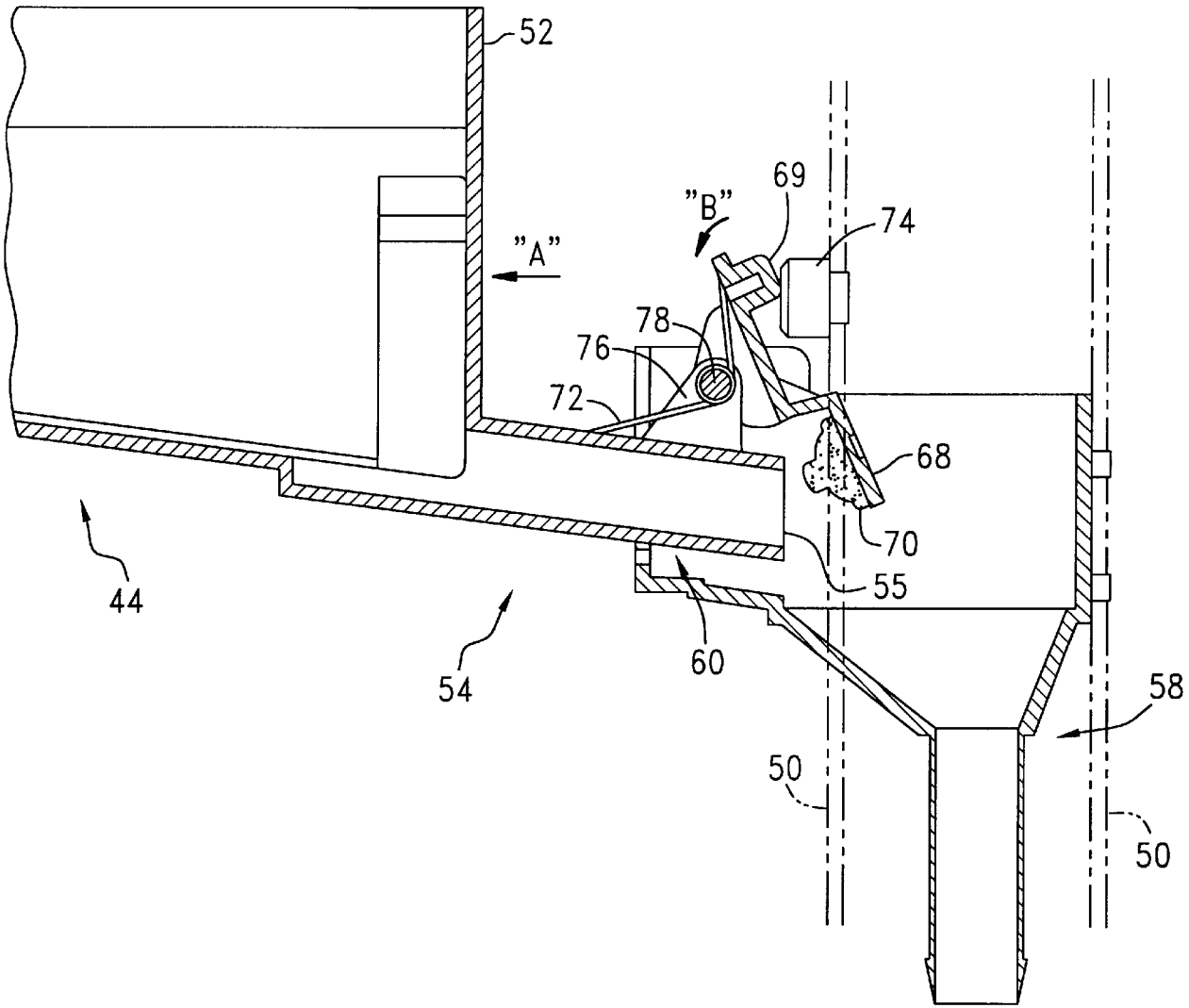

When installing the development tray 52, the discharge portion 54 is placed on the receiving portion 60 of the developer drain tray 58, and the development tray 52 is further moved in a direction indicated by arrow A. Then, as shown in FIG. 4, protrusion 69, formed on the packing holder 68, contacts and is pushed by push member 74 so that packing holder 68 pivots over hinge shaft 78 in the direction indicated by arrow B. Thus, the packing member 70 moves to open outlet 55 when packing holder 68 is engaged as described, resulting in the installation of the development tray 52. Upon insertion, the development tray 52 is fixed to the chassis 50 by a coupling means (not shown). Consequently, a normal development process is made possible and any developer remaining in the development tray 52 after the development process is finished can be discharged through the discharge portion 54 and the developer drain tray 58 to the circulation tank 40 (see FIG. 2).

Next, prior to repairing the development unit, the coupling means is dismantled to freely separate the development tray 52 from the chassis 50. Development tray 52 is moved in a direction A of FIG. 4, and packing holder 68 is elastically biased in a direction B of FIG. 3, by the elastic force of spring member 72. As packing holder 68 pivots, packing member 70 closes outlet 55 of discharge portion 54. In this state, when development tray 52 is further moved in a direction C of FIG. 3 to completely separate the development tray 52 from chassis 50, outlet 55 is closed by the packing member 70, preventing components in the main body of the printer from being damaged by any developer remaining in development tray 52.

Figure 5:
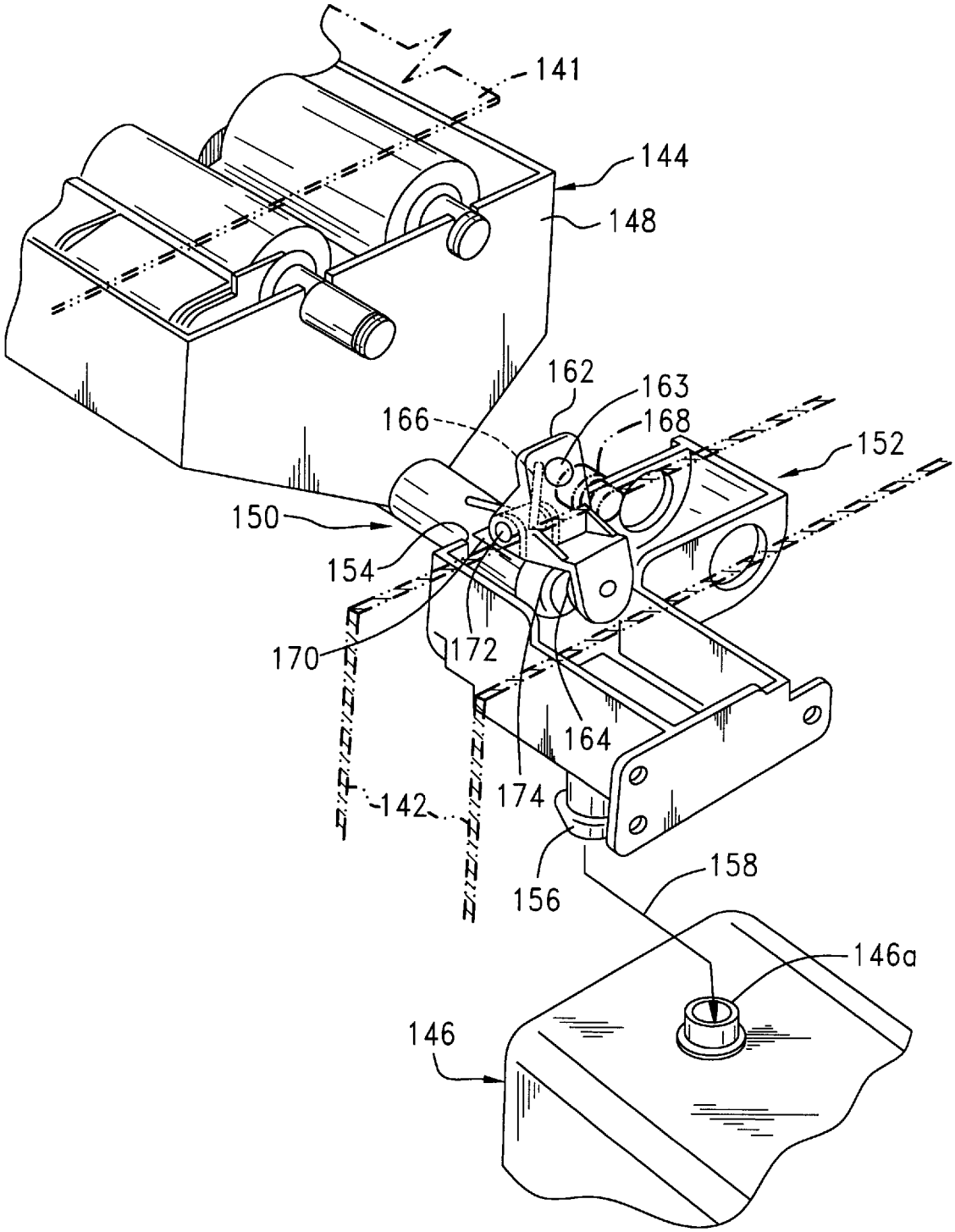
FIG. 5 is a perspective view showing an ink leakage prevention system of a development tray for a liquid electrophotographic printer according to the second preferred embodiment of the present invention.

FIG. 5 shows an ink leakage prevention system for a liquid electrophotographic printer having a development tray according to a second preferred embodiment of the present invention. In the second embodiment, a guide member is attached near the outlet 151 to prevent ink leakage.

As shown in FIG. 5, the main body of the printer is sectioned by a chassis 142 into a development unit 144 and a circulation tank 146. A development tray 148 is installed at the lower portion of the development unit 144 and is detachable from the main body of the printer. The development tray 148 accommodates developer which is supplied from a circulation tank 146 and used in development unit 144 for developing. The bottom of the development tray 148 is designed with an inclined portion slanted at a predetermined angle with respect to the widthwise direction of a photoreceptor medium 141. A discharge portion 150 is provided at the inclined portion for discharging any developer accommodated in the development tray 148 into circulation tank 146. For brevity, all the elements described with reference to FIG. 1 are installed in the development tray 148.

A drain tray 152 is installed at the side surface of chassis 142. Drain tray 152 interacts with discharge portion 150 of development tray 148, such that discharge portion 150 contacts or becomes separated from drain tray 152 when the development tray 148 is installed in or detached from the main body of the printer. Accordingly, the developer drain tray 152 is provided with a receiving portion 154 for accommodating discharge portion 150. A drain portion 156 is formed at the bottom of drain tray 152 for connecting to the circulation tank 146. The drain portion 156 is connected to inlet 146*a* formed at circulation tank 146 via a path 158.

A discharge portion opening/shutting means is installed at chassis 142 for receiving the discharge portion 150. When the development tray 148 is separated from the drain tray 152, the discharge portion opening/shutting means shuts discharge portion 150 so that any developer remaining in development tray 148 cannot be discharged through discharge portion 150. When development tray 148 is coupled to the drain tray 152, the discharge portion opening/shutting means opens discharge portion 150 so that development tray 148 is fluidly connected to circulation tank 146. The discharge portion opening/shutting means includes a packing holder 162, a packing member 164, a spring member 166 and a push member 168.

Packing holder 162 pivots on hinge shaft 172 which is installed in rib 170 extending from discharge portion 150. Packing member 164 is installed at one end of packing holder 162 to selectively open or shut outlet 151 (see FIG. 6) formed at the leading end of the discharge portion 150, according to the pivoting movement of packing holder 162. Spring member 166 is wound around hinge shaft 172 such that the end portions of spring member 166 contacts both discharge portion 150 and packing holder 162. Spring member 166 elastically biases packing holder 162 in a direction to shut outlet 151 of discharge portion 150 so that packing holder 162 pivots with respect to rib 170. When development tray 148 is coupled to drain tray 152, push member 168, installed on chassis 142, pushes protrusion 163 formed on packing holder 162 so that the packing holder 162 pivots against the elastic force of spring member 166 to open outlet 151. Here, spring member 166 and the push member 168 act as a pivoting portion to make packing holder 162 pivot.

Figure 6:
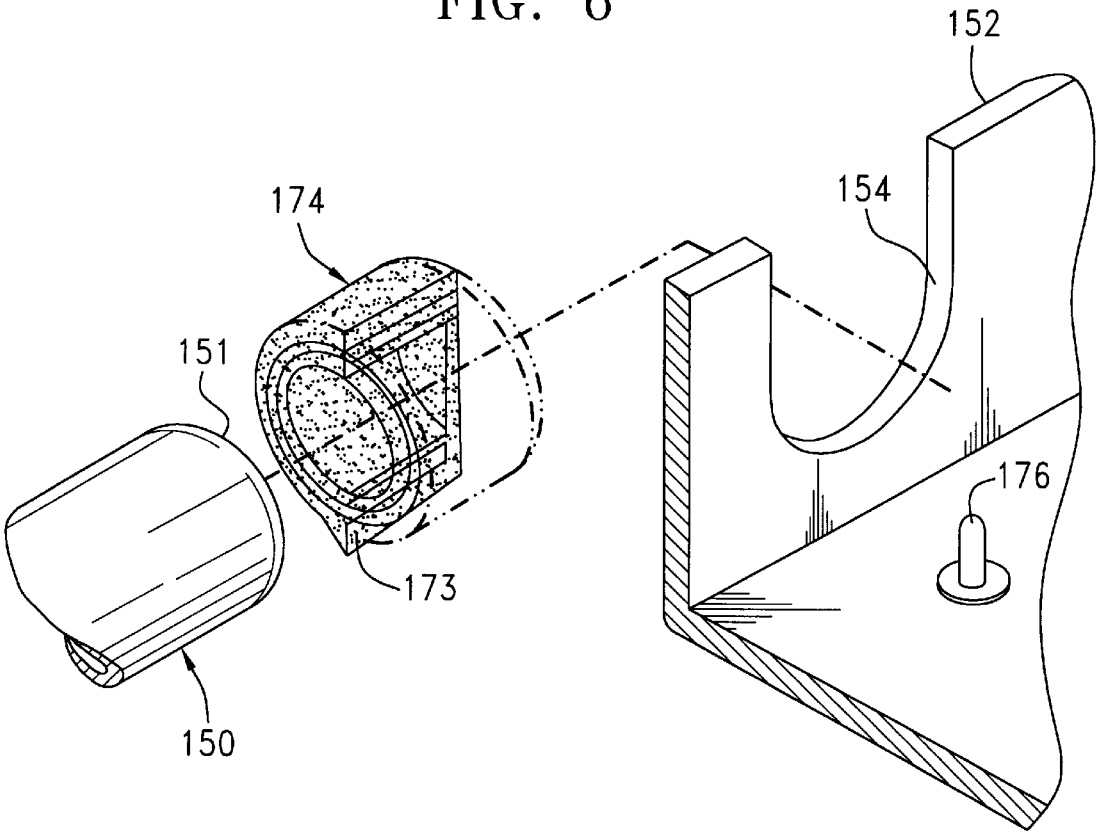
FIG. 6 is an exploded perspective view showing a guide member installed at an outlet shown in FIG. 5.

As shown in FIG. 6, guide member 174 is inserted into discharge portion 151 and blade 176 is installed in receiving portion 154 of drain tray 152.

Guide member 174 is formed with a guide portion 173 having a predetermined inclined shape to guide the flow of developer drops remaining around outlet 151 after the packing member 164 closes outlet 151. Preferably, guide portion 173 is formed of a rubber material, or the like, which is the same material used for packing member 164.

The Blade 176 is positioned in the drain tray 152 to contact guide member 174 and collect any developer drops formed on guide portion 173, when the development tray 148 is being separated from drain tray 152.

Figure 7:
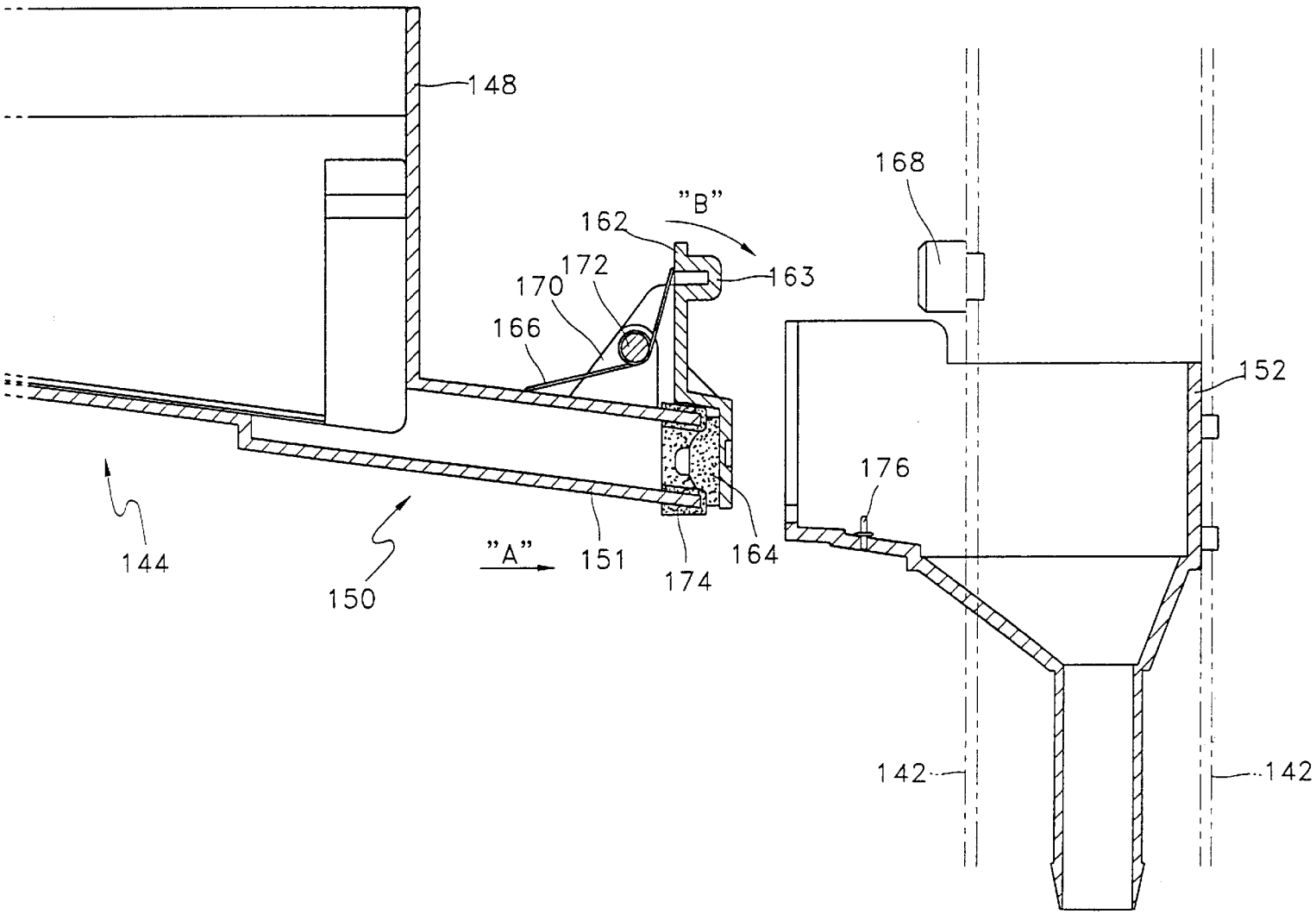

During the operation of the ink leakage prevention system for a liquid electrophotographic printer having a development tray according to the second preferred embodiment of the present invention, as shown in FIG. 7, packing holder 162 is elastically biased in a closed position by spring member 166. When the development tray 148 is detached from the liquid electrophotographic printer, the elastic force of spring member 166 upon packing holder 162 causes packing member 164, installed on packing holder 162, to close outlet 151 of discharge portion 150.

Figure 8:
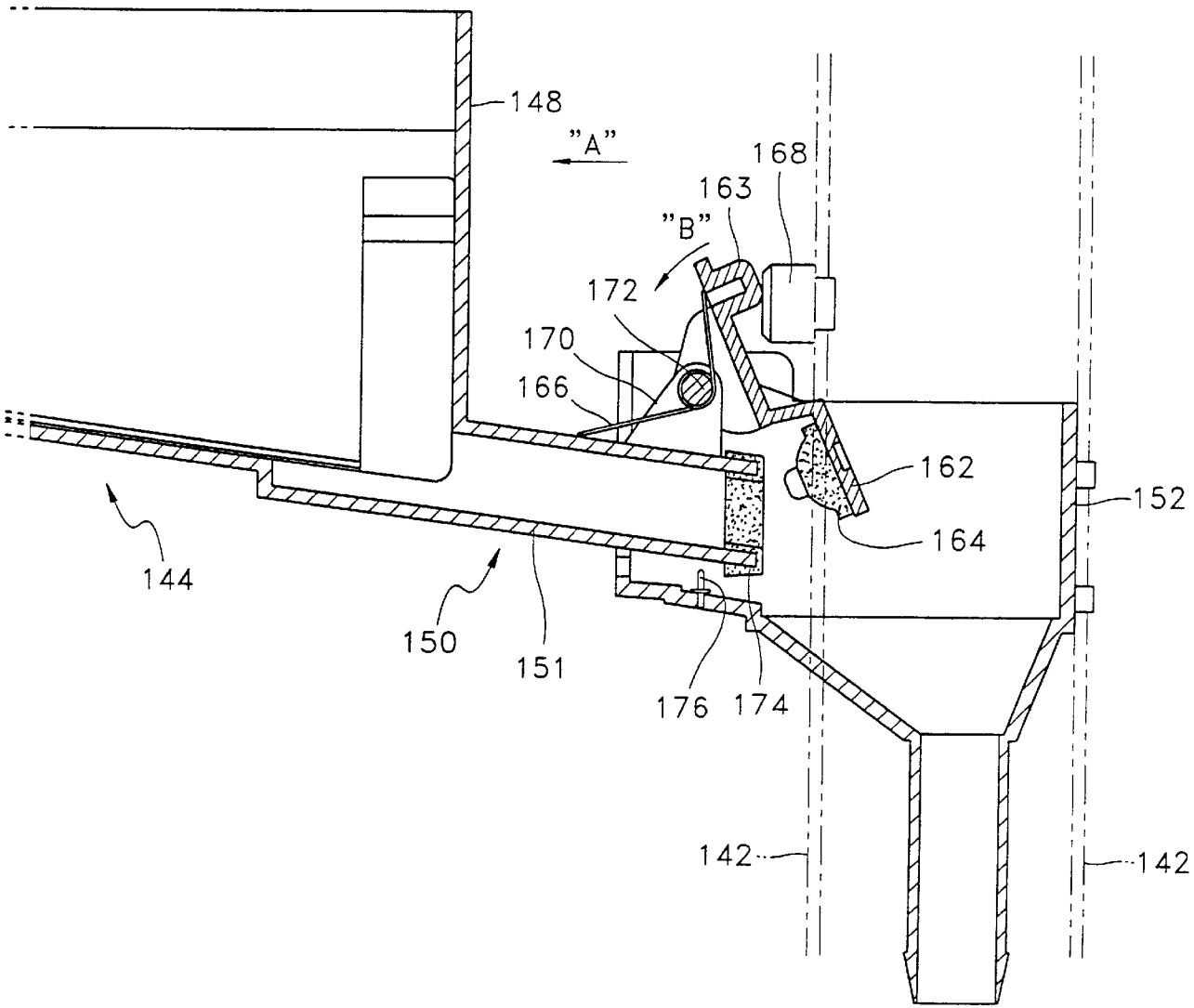

When installing development tray 148, discharge portion 150 is placed on receiving portion 154 of drain tray 152, and development tray 148 is further moved in a direction indicated by arrow A. Then, as shown in FIG. 8, protrusion 163, formed on packing holder 162, contacts and is pushed by push member 168 so that packing holder 162 pivots over hinge shaft 172 in the direction indicated by arrow B. Thus, packing member 164 moves to open outlet 151, when packing holder 162 is engaged as described above, upon installation of development tray 148. Upon insertion, development tray 148 is fixed to chassis 142 by a coupling means (not shown). Consequently, a normal development process is made possible and any developer remaining in development tray 148 after the development process is discharged through discharge portion 150 and drain tray 152 to circulation tank 146 (see FIG. 5).

Next, prior to repairing the development unit, the coupling means is dismantled to freely separate development tray 148 from chassis 142. Development tray 148 is moved in a direction A of FIG. 8, and packing holder 162 is elastically biased in a direction B of FIG. 7 by the elastic force of spring member 166. As packing holder 162 pivots, packing member 164 closes outlet 151 of discharge portion 150. In this state, when development tray 148 is further moved in the direction A of FIG. 8 to completely separate development tray 148 from chassis 142, outlet 151 is closed by packing member 164, preventing components in the main body of the printer from being damaged by any developer remaining in development tray 148. Further, any developer drops formed on guide member 174 are secondarily removed by blade 176 before packing member 164 completely closes outlet 151 and the removed developer drops are accommodated in drain tray 152. Thus, when development tray 148 is completely separated from chassis 142, any developer remaining in development tray 148 is completely prevented from falling onto and damaging the parts in the main body of the printer because any developer drops formed around the outlet 151 are removed.

Figure 9:
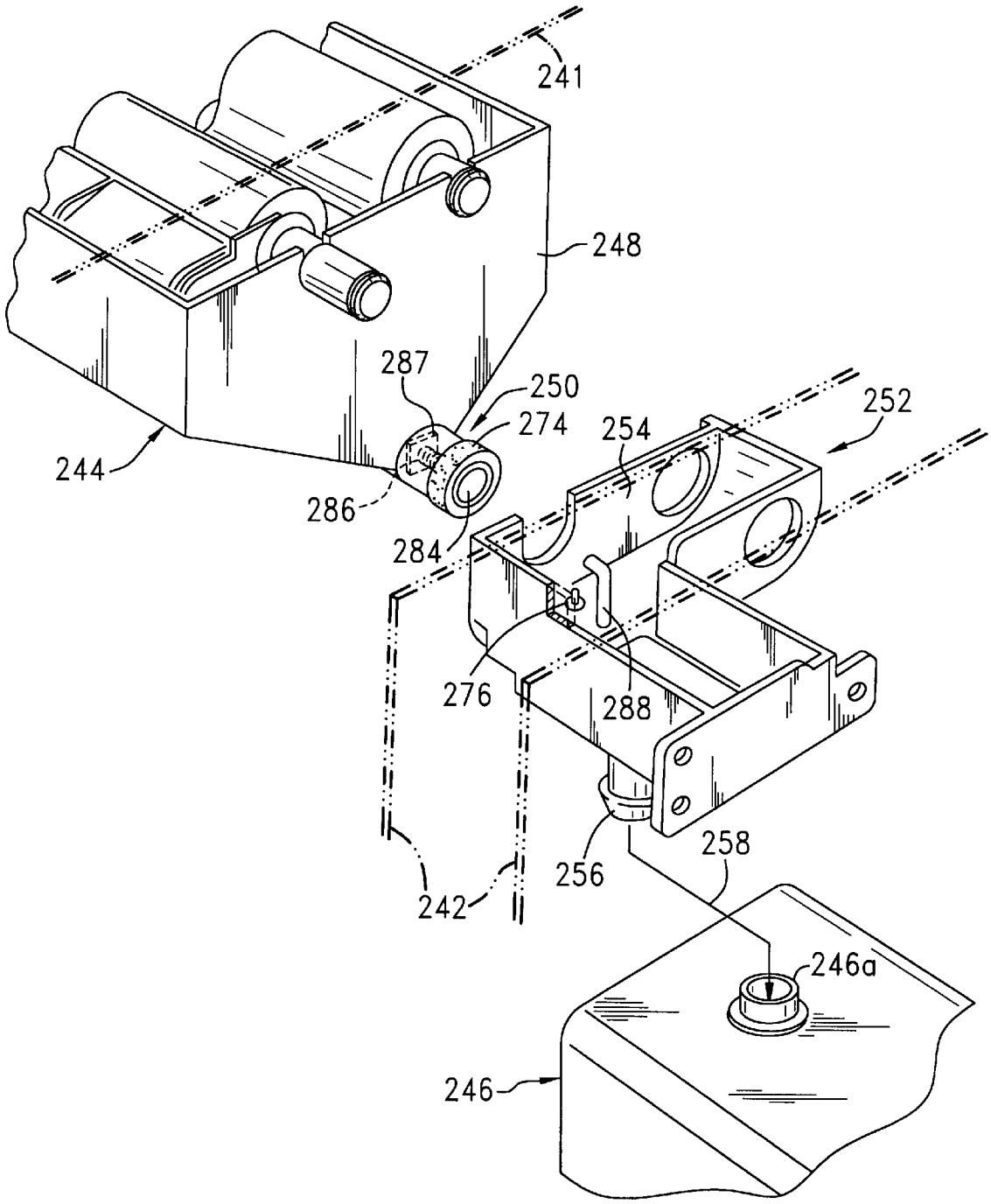
FIG. 9 is a perspective view showing an ink leakage prevention system of a development tray for a liquid electrophotographic printer according to the third preferred embodiment of the present invention.
Figure 10:
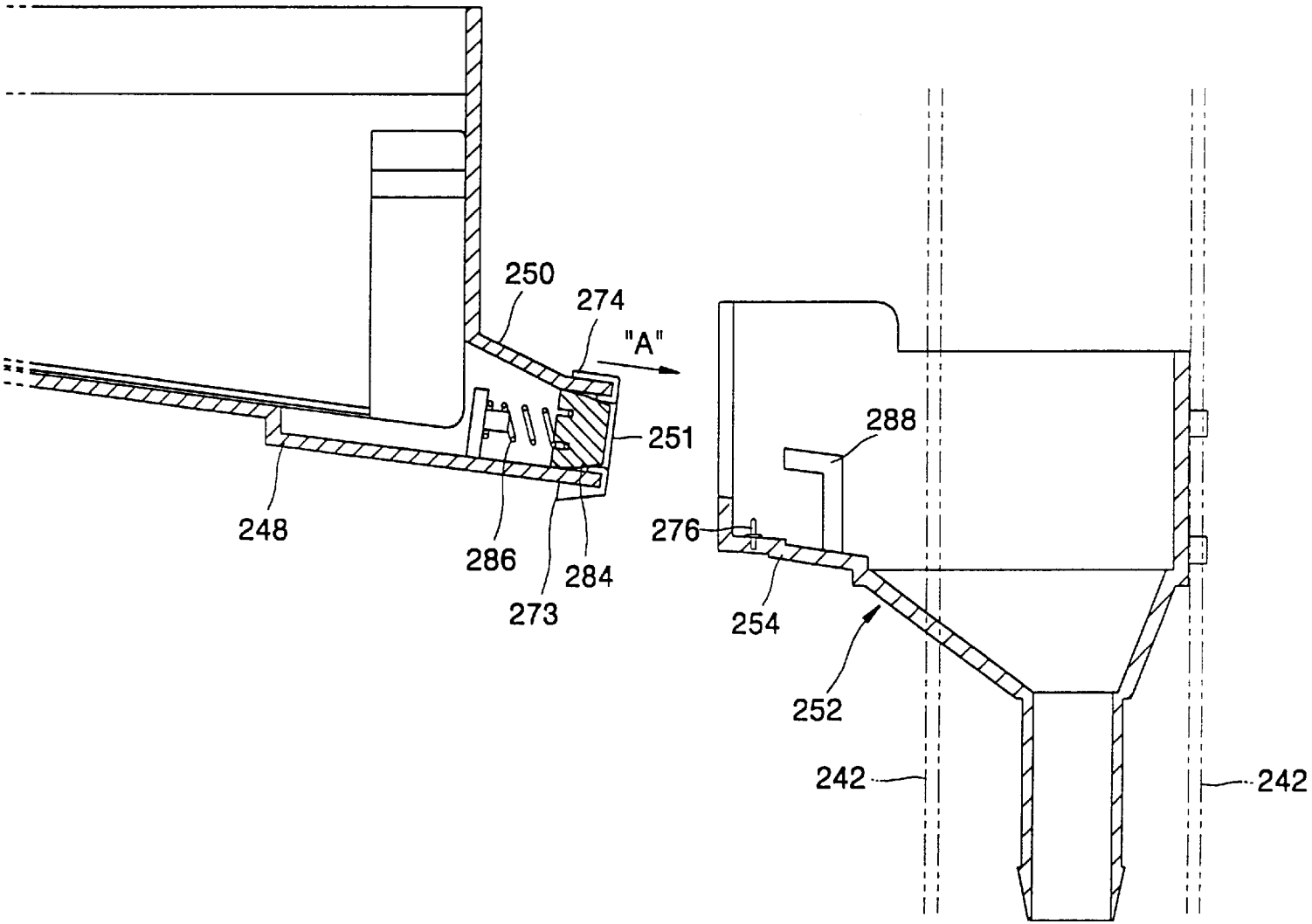
Figure 11:
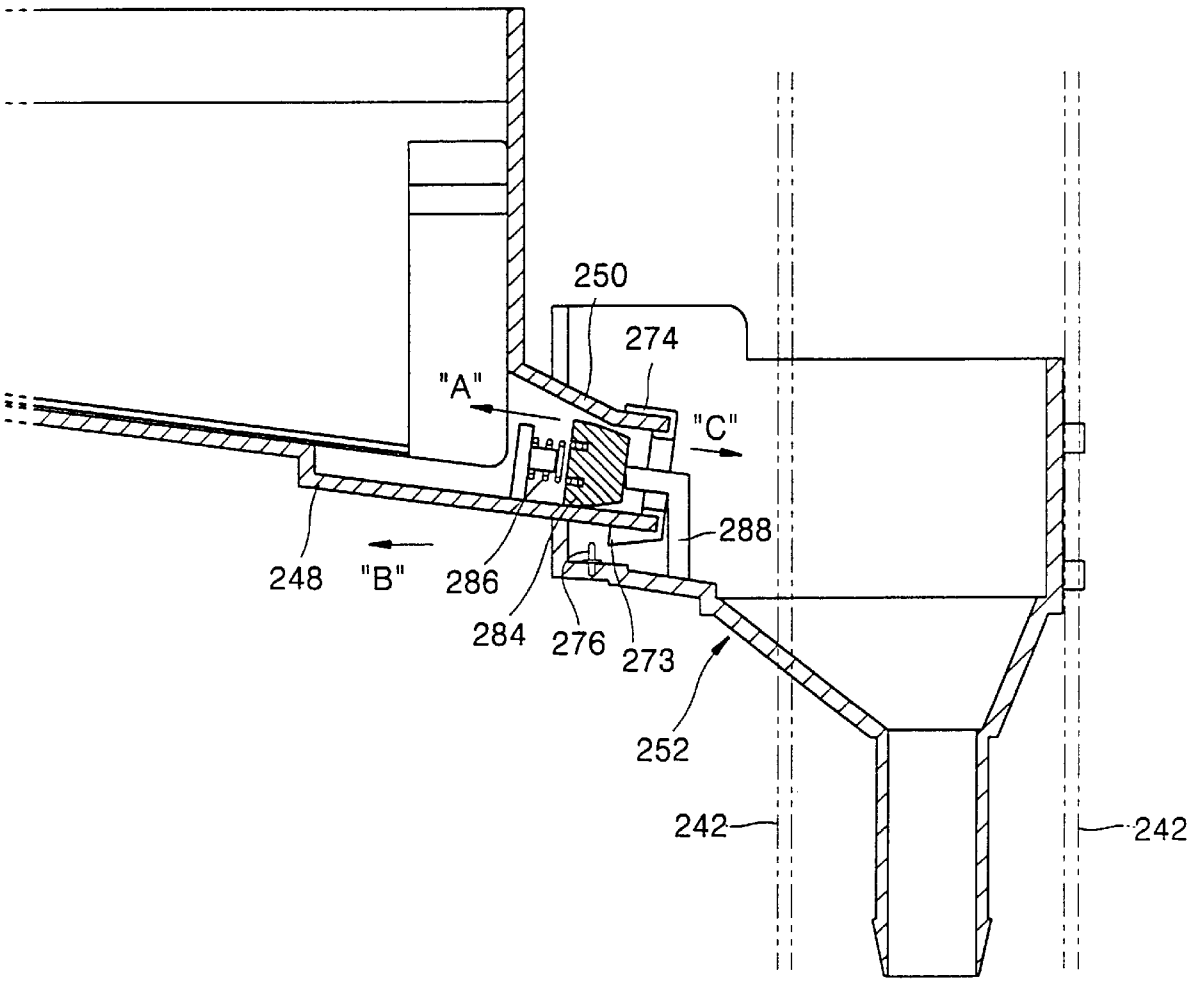

FIGS. 9 through 11 show an ink leakage prevention system for a liquid electrophotographic printer having a development tray according to the third preferred embodiment of the present invention. In the third embodiment, the discharge portion opening/shutting means for selectively opening/shutting an outlet is modified, while the remaining elements remain the same as those in the abovedescribed second preferred embodiment.

The discharge portion opening/shutting means includes a packing member 284 installed in outlet 250 and is capable of sliding; an intruder 288, installed at the drain tray 252, which pierces an end portion of outlet 251 (see FIG. 10) of the discharge portion 250 and pushes packing member 284 toward the inside of the development tray 248; and an elastic member 286 for elastically biasing packing member 284 toward the leading end of the discharge portion 250. Here, one end of the elastic member 286 is connected to stopper 287 installed in discharge portion 250.

During the operation of the ink leakage prevention system for a liquid electrophotographic printer having a development tray according to the third preferred embodiment of the present invention, as shown in FIG. 10, packing member 284 is installed in discharge portion 250 of development tray 248 and is elastically biased toward the leading end of outlet 251 by elastic member 286 to close outlet 251. When installing development tray 248, discharge portion 250 is placed on receiving portion 254 of drain tray 252 and development tray 248 is further moved in a direction A. Then, as shown in FIG. 11, packing member 284 contacts and is pushed by intruder 288. As packing member 284 is moved in a direction A of FIG. 11, packing member 284 opens outlet 251 so that development tray 248 is installed in drain tray 252. In this state, development tray 248 is fixed by a coupling means (not shown) to chassis 242. Then, a normal development process is made possible and any developer remaining in development tray 248 after the development process is discharged to circulation tank 246 through outlet 251 and drain tray 252.

Next, prior to repairing the development unit, the coupling means is dismantled to freely separate the development tray 248 from chassis 242 and development tray 248 is moved in a direction B of FIG. 11. Then, packing member 284 is elastically biased in a direction C by the elastic force of elastic member 286. Here, while guide portion 273 of guide member 274 contacts blade 276, development tray 248 is further moved in a direction B until development tray 248 is completely separated from drain tray 252. Then, any developer drops remaining around outlet 251 are collected by blade 276 into drain tray 252. Thus, when development tray 248 is separated from drain tray 252, any developer drops remaining around outlet 251 are prevented from falling onto and damaging the parts in the main body of the printer.

As described above, the ink leakage prevention system for a liquid electrophotographic printer having a development tray according to the present invention has the following advantages.

First, the above embodiments provide simple structure for a packing holder, having a packing member directly installed at the discharge portion, so that any developer remaining in the development tray is prevented from falling onto and damaging the parts in the main body of the printer when the development tray is detached for replacement or repair.

Second, the packing member and packing holder at the discharge portion of the development tray form a single unit, simplifying the manufacture and repair of the elements of the discharge portion opening/shutting means.

Third, coupling a guide member, made from the same material as the packing member and formed with an included guide portion, to the leading end of the outlet of the development tray allows any developer drops flowing along the guide portion to be collected by a blade and deposited into the drain tray. This prevents the parts in the main body of the printer from being damaged by any developer remaining in the development tray when the development tray is replaced or repaired.

What is claimed is:

1. An ink leakage prevention system for a liquid electrophotographic printer having a development tray, said system comprising:

a chassis installed at a main body of said printer;

said development tray installed in a development unit of said main body of said printer;

a discharge portion of said development tray which discharges developer accumulated in a development unit; and a drain tray installed on said chassis which receives the developer discharged from said development tray.

2. The ink leakage prevention system according to claim 1, wherein said development tray is installed in a low portion of a development unit of said main body of said printer.

3. The ink leakage prevention system according to claim 1, wherein said development tray is detachable from said main body of said printer.

4. The ink leakage prevention system according to claim 1, wherein said drain tray discharges to a circulation tank.

5. The ink leakage prevention system according to claim 1, wherein said discharge portion comprises:

at least one rib extending from said discharge portion of said development tray;

a packing holder coupled to said rib; and a packing member positioned on said packing holder to open or shut an outlet formed at a leading end of said discharge portion of said development tray.

6. The ink leakage prevention system according to claim 5, wherein said packing member is hinge-coupled to said at least one rib.

7. The ink leakage prevention system according to claim 5, wherein said packing member opens or shuts said outlet formed on said leading end of said discharge portion of said development tray according to a pivoting movement of said packing holder.

8. The ink leakage prevention system according to claim 5, further comprising:

a hinge shaft coupling said packing holder to said at least one rib;

a spring member installed on said hinge shaft and elastically biasing said packing holder in a direction to press said packing member against said outlet, thereby closing said outlet; and a push member installed on said chassis which pushes against an elastic force of said spring member when said development tray is coupled to said drain tray.

9. The ink leakage prevention system according to claim 5, further comprising:

a guide member inserted on said leading end of said discharge portion of said development tray;

a guide portion, formed on said guide member, having a predetermined shape to guide developer away from said outlet; and a blade installed in said drain tray to contact said guide portion.

10. The ink leakage prevention system according to claim 9, wherein said guide member is constructed of a rubber material.

11. The ink leakage prevention system according to claim 9, wherein said guide portion is wedge-shaped.

12. The ink leakage prevention system according to claim 9, wherein said packing member is hinge-coupled to said at least one rib.

13. The ink leakage prevention system according to claim 9, wherein said packing member opens or shuts said outlet formed on said leading end of said discharge portion of said development tray according to a pivoting movement of said packing holder.

14. The ink leakage prevention system according to claim 9, further comprising:

a hinge shaft coupling said packing holder to said at least one rib;

a spring member installed on said hinge shaft and elastically biasing said packing holder in a direction to press said packing member against said outlet, thereby closing said outlet; and a push member installed on said chassis which pushes against an elastic force of said spring member when said development tray is coupled to said drain tray.

15. The ink leakage prevention system according to claim 1, wherein said discharge portion comprises:

a packing member located within said discharge portion of said development tray and moving within said discharge portion upon being contacted by an intruder;

a stopper located inside said discharge portion of said development tray;

an elastic member installed between said stopper and said packing member, wherein said elastic member elastically biases said packing member toward a leading end of said discharge portion; and wherein said drain tray includes said intruder which contacts said packing member when said development tray is coupled to said drain tray.

16. The ink leakage prevention system according to claim 1, wherein said discharge portion comprises:

a guide member inserted on said leading end of said discharge portion of said development tray;

a guide portion formed on said guide member and having a predetermined shape to guide the developer away from said outlet;

a packing member located within said discharge portion of said development tray and moving within said discharge portion upon being contacted by an intruder;

a stopper located inside said discharge portion of said development tray;

an elastic member installed between said stopper and said packing member, wherein said elastic member elastically biases said packing member toward a leading end of said discharge portion;

and wherein said drain tray comprises:

a blade to contact said guide portion; and said intruder which contacts said packing member when said development tray is coupled to said drain tray.

17. An ink leakage prevention system, having a discharge portion comprising:

at least one rib extending from said discharge portion;

a packing holder coupled to said rib; and a packing member positioned on said packing holder to open or shut an outlet formed at a leading end of said discharge portion.

18. The ink leakage prevention system according to claim 17, wherein said packing member is hinge-coupled to said at least one rib.

19. The ink leakage prevention system according to claim 17, wherein said packing member opens or shuts said outlet formed on said leading end of said discharge portion according to a pivoting movement of said packing holder.

20. The ink leakage prevention system according to claim 17, further comprising:

a hinge shaft coupling said packing holder to said at least one rib; and a spring member installed on said hinge shaft and elastically biasing said packing holder in a direction to press said packing member against said outlet, thereby closing said outlet.

21. The ink leakage prevention system according to claim 17, further comprising:

a guide member inserted on said leading end of said discharge portion; and a guide portion, formed on said guide member, having a predetermined shape to guide developer away from said outlet.

22. The ink leakage prevention system according to claim 21, wherein said guide member is constructed of a rubber material.

23. The ink leakage prevention system according to claim 21, wherein said guide portion is wedge-shaped.

24. The ink leakage prevention system according to claim 21, wherein said packing member is hinge-coupled to said at least one rib.

25. The ink leakage prevention system according to claim 21, wherein said packing member opens or shuts said outlet formed on said leading end of said discharge portion according to a pivoting movement of said packing holder.

26. The ink leakage prevention system according to claim 21, further comprising:

a hinge shaft coupling said packing holder to said at least one rib; and a spring member installed on said hinge shaft and elastically biasing said packing holder in a direction to press said packing member against said outlet, thereby closing said outlet.

27. An ink leakage prevention system, having a discharge portion comprising:

a packing member located within said discharge portion and being capable of moving within said discharge portion;

a stopper located inside said discharge portion; and an elastic member installed between said stopper and said packing member; wherein said elastic member elastically biases said packing member toward a leading end of said discharge portion.

28. An ink leakage prevention system, having a discharge portion comprising:

a guide member inserted on said leading end of said discharge portion;

a guide portion formed on said guide member and having a predetermined shape to guide the developer away from said outlet;

a packing member located within said discharge portion and being capable of moving within said discharge portion;

a stopper located inside said discharge portion of said development tray; and an elastic member installed between said stopper and said packing member, wherein said elastic member elastically biases said packing member toward a leading end of said discharge portion.

29. An ink leakage prevention system for a liquid electrophotographic printer having a development tray, said system comprising:

a chassis installed at a main body of said printer;

said development tray installed in a development unit of said main body of said printer;

a drain tray installed on said chassis which receives the developer discharged from said development tray; and a discharge portion opening/shutting means for closing said discharge portion of said development tray when said development tray is separated from said drain tray, and for opening said discharge portion of said development tray when said development tray is coupled to said drain tray.

30. The ink leakage prevention system according to claim 29, wherein said discharge portion opening/shutting means comprises:

means for attaching a packing holder to said discharge portion of said development tray;

means for pivotally coupling said packing holder to a discharge portion of said development tray;

means for elastically biasing said packing holder in a direction to press a packing member against an outlet;

means for pushing against said elastic biasing force when said development tray is coupled to said drain tray; and means for selectively opening or shutting an outlet formed at a leading end of said discharge portion of said development tray.

31. An ink leakage prevention system for a liquid electrophotographic printer having a discharge portion opening/shutting means comprising:

means for attaching a packing holder to said discharge portion of said development tray;

means for pivotally coupling said packing holder to a discharge portion of said development tray;

means for elastically biasing said packing holder in a direction to press a packing member against an outlet;

means for pushing against said elastic biasing force when said development tray is coupled to said drain tray; and means for selectively opening or shutting an outlet formed at a leading end of said discharge portion of said development tray.

32. A method of opening a discharge portion of a development tray placed within a liquid electophotographic printer, having a chassis installed at a main body of said printer, a development tray installed in a development unit of said main body of said printer, a discharge portion of said development tray which discharges developer accumulated in a development unit; and a drain tray installed on said chassis which receives the developer discharged from said development tray, comprising the steps of:

(a) placing said discharge portion of said development tray to a receiving portion of said drain tray; and (b) pushing said development tray toward said drain tray so that a protrusion formed on a packing holder pushes against a push member located on said chassis, thereby causing said packing holder to pivot and open an outlet on said discharge portion of said development tray.

33. A method of closing a discharge portion of a development tray placed within a liquid electophotographic printer, having a chassis installed at a main body of said printer, a development tray installed in a development unit of said main body of said printer, a discharge portion of said development tray which discharges developer accumulated in a development unit; and a drain tray installed on said chassis which receives the developer discharged from said development tray, comprising the step of:

(a) pulling said development tray away from said drain tray so that a protrusion formed on a packing holder breaks contact with a push member located on said chassis, thereby causing said packing holder to pivot and close an outlet on said discharge portion of said development tray.

* * * * *